US007230206B1

(12) United States Patent
Randall

(10) Patent No.: US 7,230,206 B1
(45) Date of Patent: Jun. 12, 2007

(54) BATTERY OPERATED HEATED JACKET

(76) Inventor: Josphlynn Randall, 13034 Barlin Ave., Downey, CA (US) 90242-4408

( * ) Notice: Subject to any disclaimer, the term of this patent is extended or adjusted under 35 U.S.C. 154(b) by 0 days.

(21) Appl. No.: 11/283,658

(22) Filed: Nov. 22, 2005

(51) Int. Cl.
*H05B 1/00* (2006.01)

(52) U.S. Cl. ..... 219/211; 219/212; 219/529; 381/388; 381/385

(58) Field of Classification Search ..... 219/211, 219/212, 527–529, 535, 549; 381/388, 385
See application file for complete search history.

(56) References Cited

U.S. PATENT DOCUMENTS 1,691,472 A * 11/1928 Graham et al. ..... 219/211
2,329,766 A * 9/1943 Jacobsen ..... 219/211
3,084,241 A 4/1963 Carrona
3,999,037 A * 12/1976 Metcalf, Sr. ..... 219/211
4,404,460 A * 9/1983 Kerr ..... 219/211
4,777,344 A 10/1988 Nash et al.
4,876,724 A * 10/1989 Suzuki ..... 381/385
5,148,002 A 9/1992 Kuo et al.
5,603,648 A 2/1997 Kea
5,893,991 A 4/1999 Newell
6,049,062 A * 4/2000 Jones ..... 219/211
D429,058 S 8/2000 Derosier
6,561,814 B2 * 5/2003 Tilbury et al. ..... 439/37

* cited by examiner

*Primary Examiner*—Robin Evans
*Assistant Examiner*—Vinod Patel
(74) *Attorney, Agent, or Firm*—Crossley Patent Law; Mark A. Crossley

(57) ABSTRACT

A battery operated heated jacket, with removable body and sleeves and hood, the jacket with a removable liner, the liner further detachable from itself at the attachment of the sleeves and the hood, the attachment comprised of quick connects, the jacket comprised of a pocket containing a control box, the box containing a microprocessor, power source, heating controls, and media player, the hood comprised of earphones communicating with the media player, a detachable wire connecting the media player to the headphones.

5 Claims, 5 Drawing Sheets

BATTERY OPERATED HEATED JACKET

BACKGROUND OF THE INVENTION

The advent of heated jackets has seen attempts to solve the problems related to the same. A heated jacket with a power source is a useful personal tool. Still, more features are desirable. A removable liner containing the heating element is a desirable feature. Removable sleeves and hood could further distinguish a heated jacket. Battery power is desirable, as are rechargeable batteries. A liner that disconnects from itself at the sleeve and hood attachments is also desirable. Further, incorporating a multimedia device within the jacket provides for further pleasurable wearing. An added feature could be headphones within the hood. The present invention offers these attributes and others.

FIELD OF THE INVENTION

The invention relates to heated jackets and more specifically to a battery operated heated jacket with removable sleeves, hood, and liner, and a media player.

SUMMARY OF THE INVENTION

The general purpose of the battery operated heated jacket, described subsequently in greater detail, is to provide a battery operated heated jacket which has many novel features that result in an improved battery operated heated jacket which is not anticipated, rendered obvious, suggested, or even implied by prior art, either alone or in combination thereof.

To accomplish this, the invention comprises a battery operated heated jacket. The jacket is further comprised of a removable body and sleeves and hood. The hood and sleeves removably attach to the body via zippers. The jacket is further comprised of a removable liner. The removable liner contains the heating element. The liner attaches to the inside of the jacket via hook and loop. The liner further detaches from itself at the attachment of the sleeves to the body and at the attachment of the body to the hood. The lining attachment is further comprised of quick connects for the heating element. The jacket is comprised of a pocket containing a control box. The control box comprises a microprocessor, power source, heating controls, and media player with media controls. The control box further comprises heating controls and a switchable night light. The media player comprises a radio and a CD player, with controls. A further example comprises an MP3 player that shares controls of the control box. The hood is comprised of earphones communicating with the media player. A detachable wire connects the media player to the headphones.

Thus has been broadly outlined the more important features of the battery operated heated jacket so that the detailed description thereof that follows may be better understood and in order that the present contribution to the art may be better appreciated.

Numerous objects, features and advantages of the battery operated heated jacket will be readily apparent to those of ordinary skill in the art upon reading the following detailed description of presently preferred, but nonetheless illustrative, examples of the battery operated heated jacket when taken in conjunction with the accompanying drawings. In this respect, before explaining the current examples of the battery operated heated jacket in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the battery operated heated jacket. It is therefore important that the claims be regarded as including such equivalent constructions insofar as they do not depart from the spirit and scope of the present invention.

Objects of the battery operated heated jacket, along with various novel features that characterize the invention are particularly pointed out in the claims forming a part of this disclosure. For better understanding of the battery operated heated jacket, its operating advantages and specific objects attained by its uses, refer to the accompanying drawings and description.

DETAILED DESCRIPTION OF THE PREFERRED EXAMPLE

With reference now to the drawings, and in particular FIGS. 1 through 6 thereof, example of the battery operated heated jacket employing the principles and concepts of the present invention and generally designated by the reference number 10 will be described.

Figure 1:
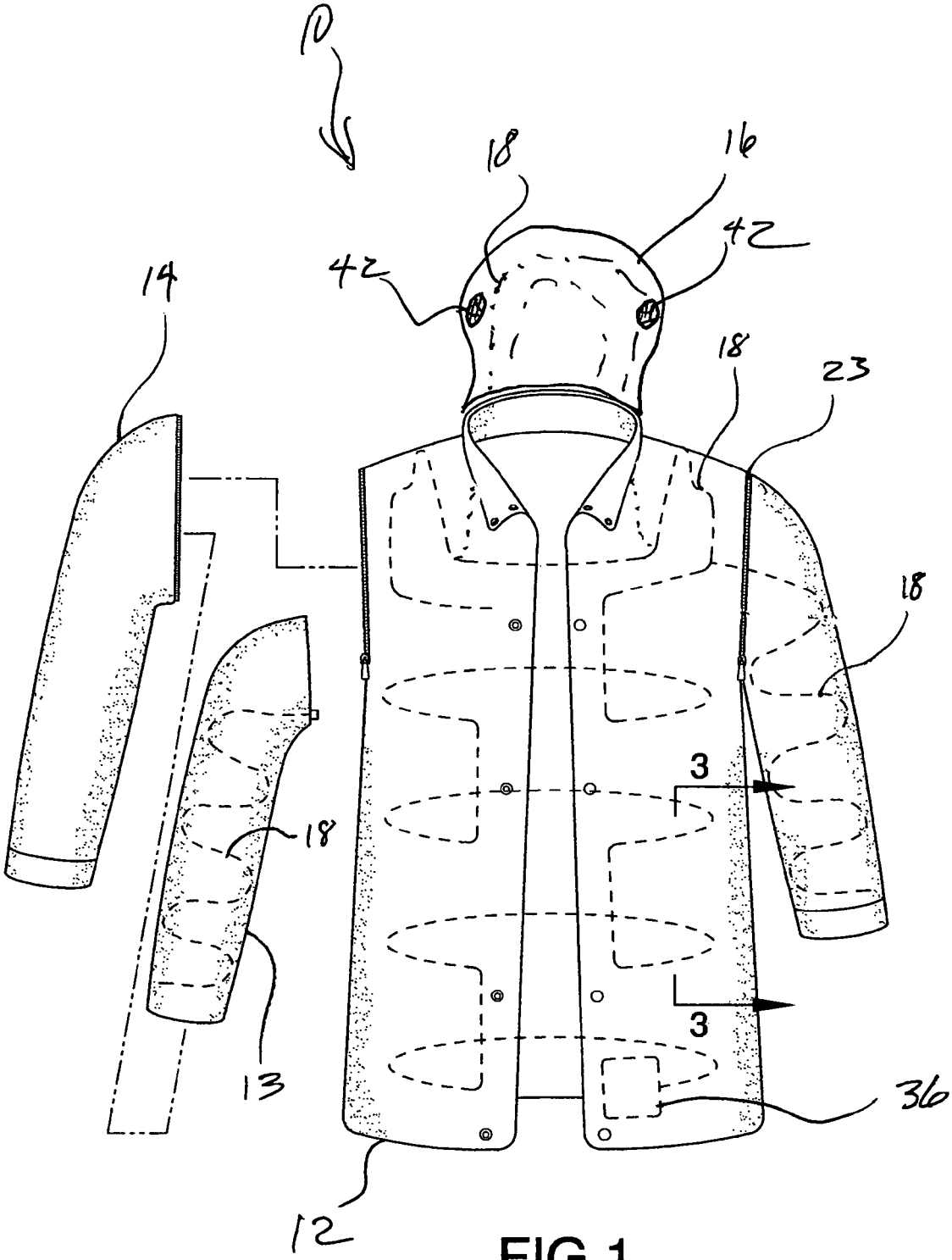
FIG. 1 is front view of the invention with one sleeve and sleeve liner removed.

Referring to FIG. 1, the invention 10 is comprised of a jacket body 12. The sleeves 14 remove from the body 12 via zippers 23. Zippers 23 are disposed at the shoulders of the body 12. The sleeve lining 13 is removed from within the sleeve 14. The removable hood 16 is attached to the body 12. The hood 16 further comprises the opposing headphones 42 disposed in either side of the hood 16. The liner 13 further comprises the heating element 18. The heating element 18 is disposed throughout the liner 13 that fits within the body 12, the sleeves 14, and the hood 16. The jacket 10 further comprises the interior pocket 36. The interior pocket 36 is disposed within the body 12 of the jacket 10.

Figure 2:
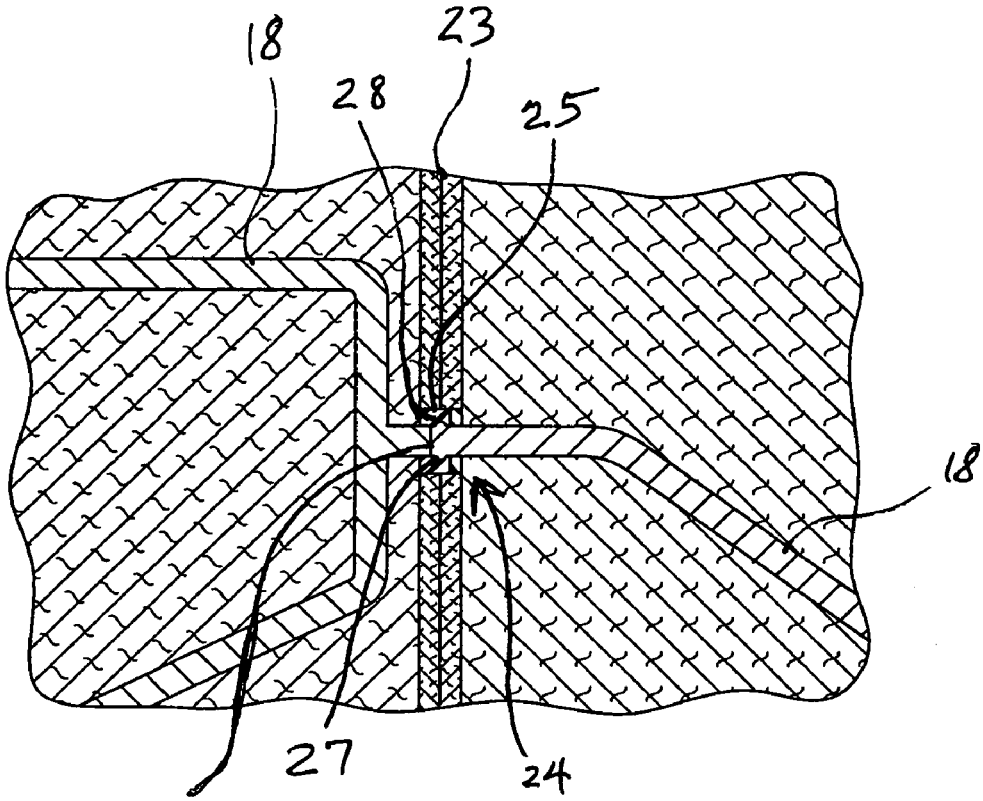
FIG. 2 is a cross sectional view of the quick connect of the heating element, the view taken along the zipper connection of the sleeve to the body.

Referring to FIG. 2, the zipper 23 is proximal to the quick connect 24. The quick connect 24 provides for rapid connection and disconnection of the heating element 18 sections. The quick connects 24 are disposed at the attachments of the liner 13 in the sleeves 14 and the body 12. The quick connects 24 are also disposed at the connection of the hood 16 to the body 12. Each quick connect is comprised of a female plug 25 at one side of the connection and a male plug 26 at the opposite side of the connection. Each female plug 25 is partially comprised of a receptacle 28. Each male plug 26 is partially comprised of a nodule 27. The nodule 27 removably inserts within the receptacle 28.

Figure 3:
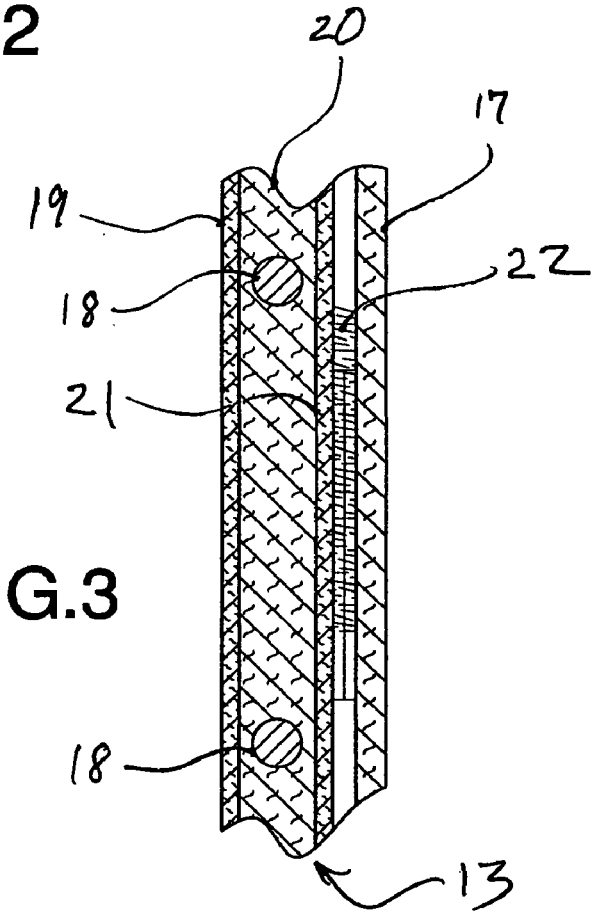
FIG. 3 is a cross sectional view of the hook and loop attachment of the liner of the jacket of FIG. 1, the view taken along the line 3—3.

Referring to FIG. 3, the liner 13 is comprised of an inner layer 19. The inner layer 19 is exposed to a user's (not shown) body. The liner 13 is further comprised of an outer layer 21. The insulation 20 of the liner 13 is sandwiched between the inner layer 19 and the outer layer 21. The heating element is embedded within the insulation 20 throughout the liner 13. The outer layer 21 is further comprised of hook and loop 22, as is the inside of the jacket sleeves 14, body 12 and hood 16. The complimentary parts of the hook and loop 22 removably fasten together. The jacket 10 is outwardly comprised of fabric 17.

Figure 4:
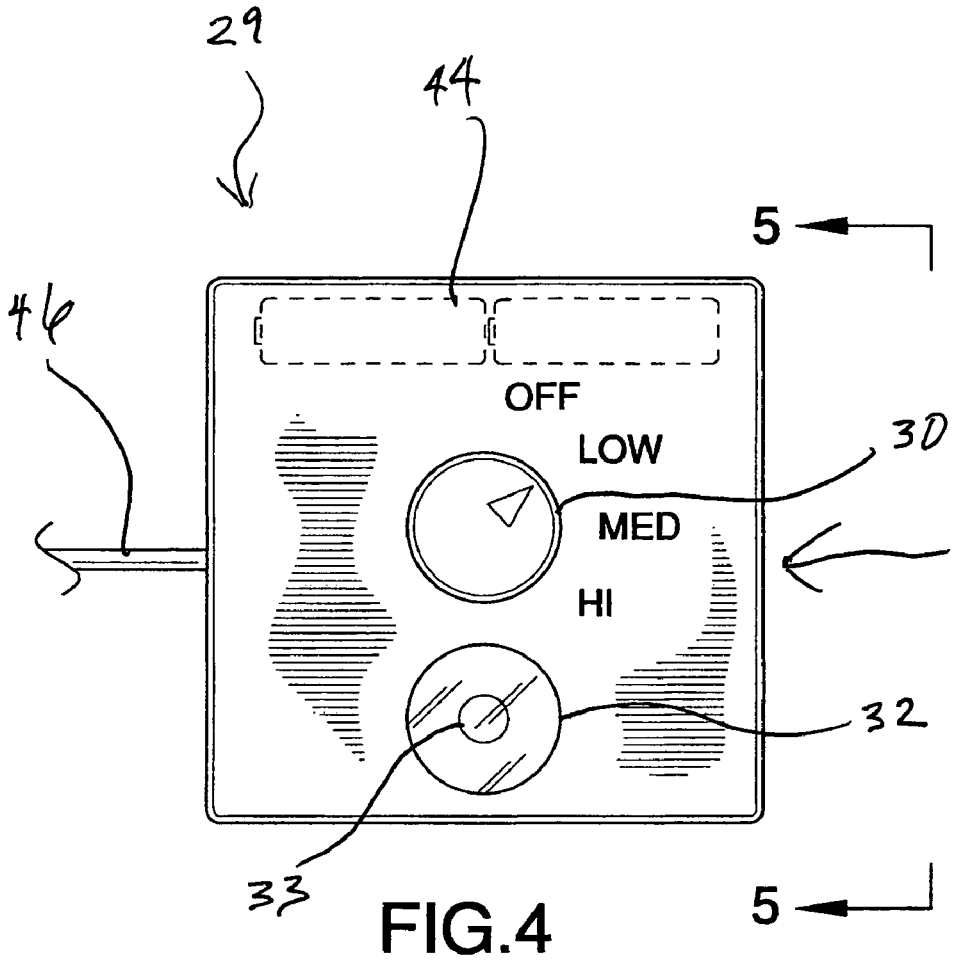
FIG. 4 is a view of the temperature control and the night light and the battery of the control box.

Referring to FIG. 4, the control box 29 houses power source 44 for powering the functions of the jacket 10. The power source is outwardly accessible (not shown). The box 29 further houses the temperature control 30 for setting the heating element 18 temperatures from off to low to medium to high. The box 29 further comprises the night light 32 with on/off button 33. Connect wire 46 connects the control box 29 to the heating element 18.

Figure 5:
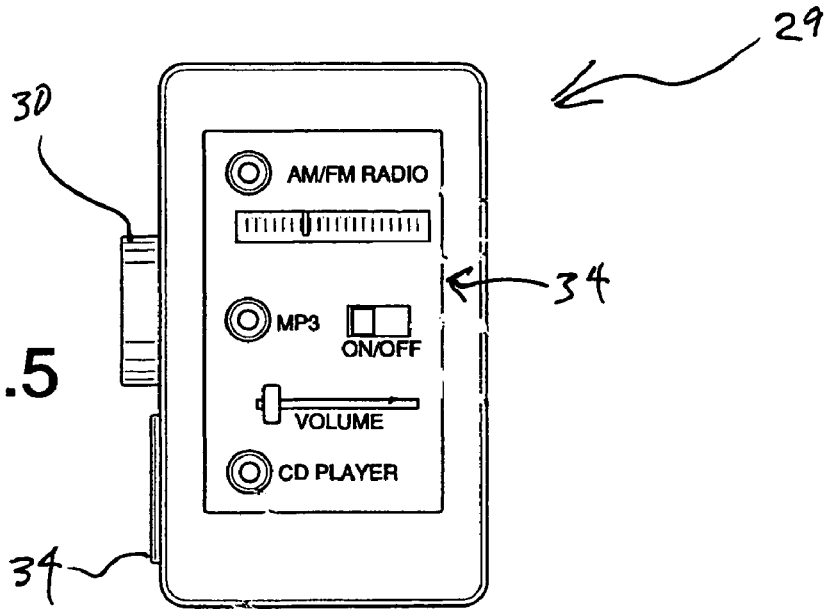
FIG. 5 is a view of the control box of FIG. 4 taken along the line 5—5, the view comprising the media device functions and controls.

Referring to FIG. 5, the control box 29 further comprises the multimedia device 34. The media device 34 is comprised of a radio, an MP3 player, a CD player, and controls for each. The control box 29 further comprises a wire (not shown) for connecting to the headphones 42 of the hood 16 (FIG. 1)

Figure 6:
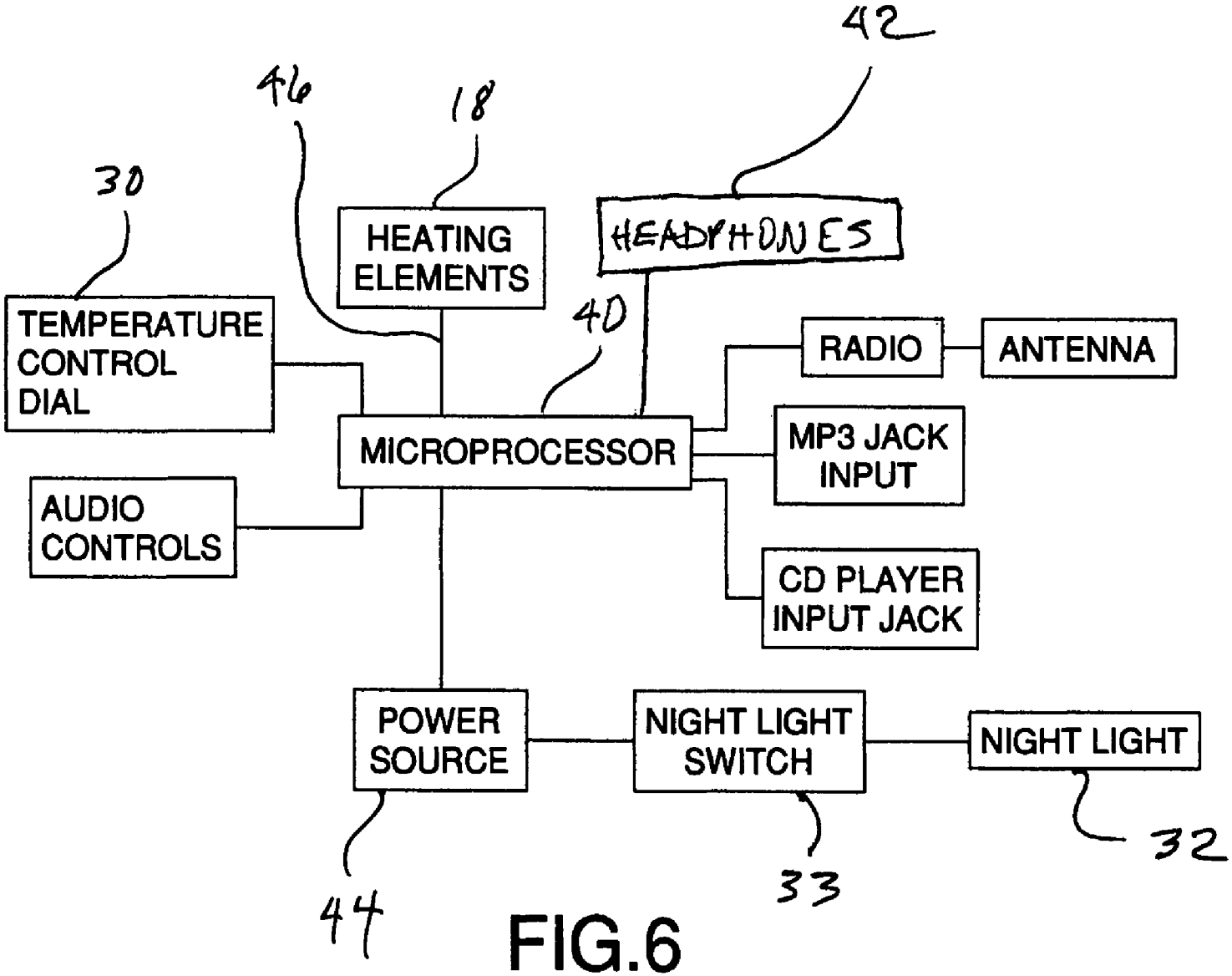
FIG. 6 is a flow chart of control box makeup and functions.

Referring to FIG. 6, the flow chart for the functions of the jacket 10 illustrate microprocessor 40 communicating with the temperature control 30 and audio controls. The microprocessor 40 further communicates with the radio, MP3 input, CD player, and headphones 42. The power source 44 powers the microprocessor 40 and the night light switch 33. The night light switch 33 signals the night light 32.

Figure 7:
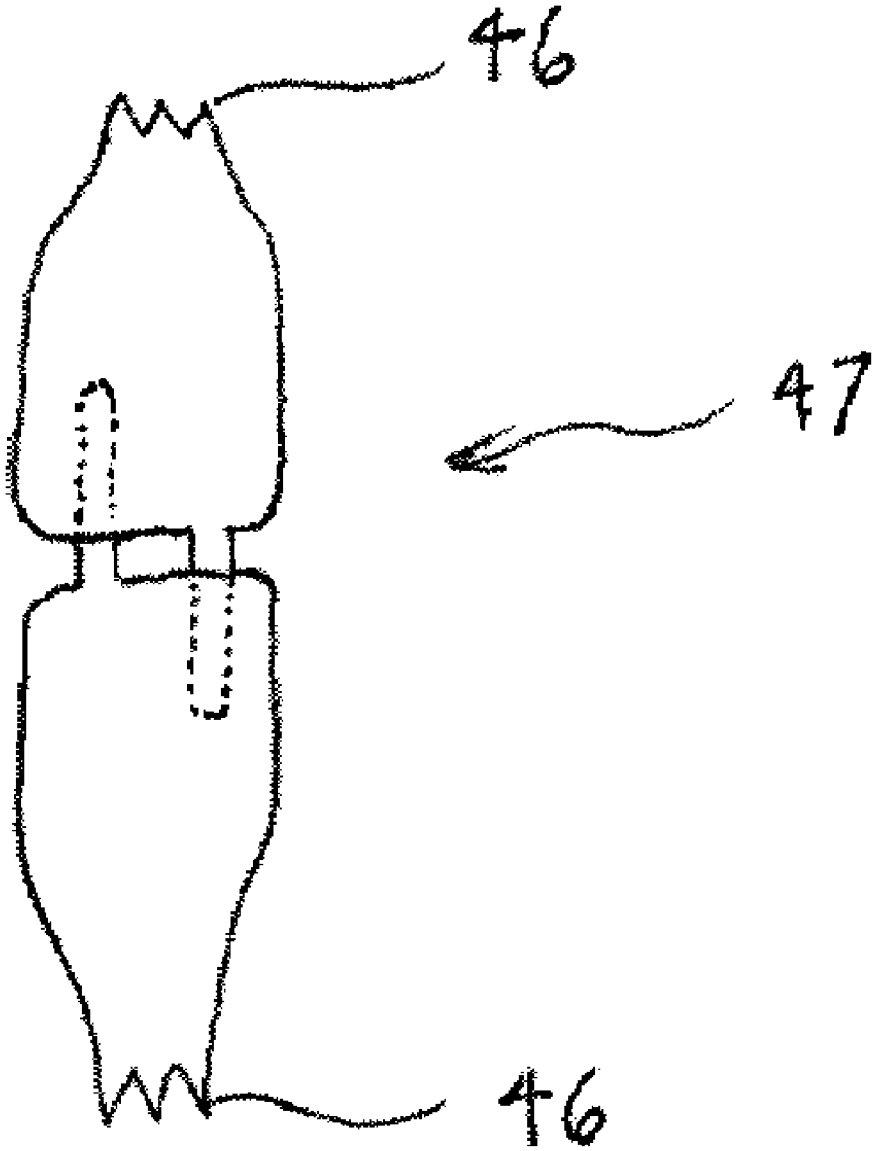
FIG. 7 is an elevation view of the detachable wire connecting the headphones to the control box.

FIG. 7 illustrates the detachable wire 47 connection. The detachable wire 47 is used to connect the headphones 42 to the control box 29. The detachable wire 47 is well known and used in electrical connection art.

With respect to the above description then, it is to be realized that the optimum dimensional relationships for the parts of the battery operated heated jacket, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A battery operated heated jacket, the jacket comprising:
- a jacket body, the body for covering a torso of a user;
- a pair of removable jacket sleeves attached to the jacket body, the sleeves for covering the arm of the user;
- a removable liner disposed within the jacket, the removable jacket liner comprising:
  - an inner layer;
  - an outer layer;
  - an insulation disposed between the inner layer and the outer layer;
- a removable liner disposed within the sleeves, the liner removably attached to the jacket liner, the sleeve liner comprising:
  - an inner layer;
  - an outer layer;
  - an insulation disposed between the inner layer and the outer layer;
- a removable hood, the hood for covering the head of a user;
- a hood liner disposed within the hood, the hood liner comprising:
  - an inner layer;
  - an outer layer;
  - an insulation disposed between the inner layer and the outer layer;
- a means for removably attaching the hood to the jacket;
- a flexible elongated heating element, the heating element disposed throughout the insulation of the liner;
- a plurality of quick connects disposed at the attachment of the hood liner to the jacket liner and at the attachment of the sleeve liners to the jacket liner, the quick disconnects comprising:
  - a female plug disposed on one side of the quick connect;
  - a receptacle within the female plug;
  - a male plug on an opposite side of the quick connect;
    - a nodule on the male plug, such that the nodule removably inserts into the receptacle;
- a control box, the control box communicating with the heating element;
- a media device disposed within the control box, the device for playing audio media;
- a power source disposed within the control box, the power source for powering the control box functions;
- a connect wire connecting the control box to the heating element;
- a connect wire connecting the control box to the media device;
- a microprocessor disposed within the control box, the microprocessor for processing the functions of the control box;
- a pair of headphones incorporated into the hood;
- a night light disposed within the control box;
- an on/off switch on the night light;
- a detachable wire disposed at the attachment of the hood to the jacket, the detachable wire connecting the headphones to the control box;
- a night light disposed within the control box;
- an on/off switch on the night light.

2. The jacket in claim 1 wherein the media device comprises a radio with controls.

3. The jacket in claim 2 wherein the media device further comprises a CD player, the DC player also controlled by the radio controls;

switching means for switching between CD and radio functions.

4. The jacket in claim 3 wherein the media device further comprises and MP3 player;

switching means for switching between the MP3 player, the radio, and the CD player.

5. The jacket in claim 4 wherein the control box further comprises a temperature control dial, the temperature control dial controlling the temperature of the heating element.

* * * * *